US006029773A

United States Patent [19]

Herrera-Casasus

[11] Patent Number: 6,029,773

[45] Date of Patent: Feb. 29, 2000

[54] TUBULAR EMERGENCY EXIT FOR BUILDINGS

[76] Inventor: Crisogono Herrera-Casasus, Risco #2300 San Pedro 66230 Garza Garcia, Nuevo Leon, Mexico

[21] Appl. No.: 09/333,656

[22] Filed: Jun. 16, 1999

[51] Int. Cl.[7] ..... A62B 1/20

[52] U.S. Cl. ..... 182/100; 182/83

[58] Field of Search ..... 182/100, 189, 182/82, 48, 129, 83

[56] References Cited

U.S. PATENT DOCUMENTS

| | | | |
|---|---|---|---|
| 791,433 | 5/1905 | Wachtershausen | 182/189 |
| 809,778 | 1/1906 | Collins | 182/189 |
| 1,482,883 | 2/1924 | Beilger | 182/85 |
| 1,883,849 | 10/1932 | Innasse | 182/100 |
| 2,945,550 | 7/1960 | Andreasen | 182/100 |
| 3,158,223 | 11/1964 | Brown . | |
| 5,377,778 | 1/1995 | Can | 182/100 |

*Primary Examiner*—Alvin Chin-Shue
*Attorney, Agent, or Firm*—Laurence R. Brown

[57] ABSTRACT

The present invention refers to a tubular escape system for buildings consisting of a combination of a platform, multiple uprights located around the perimeter of the platform to support the railings, a door connecting the building interior on that floor with each platform, a opening in each platform measuring 1.00 meter in diameter, two tubes that perpendicularly cross each platform and are connected to a water tank that can manually or automatically fill the tubes with water, an extension tube that remains fixed and inserted within the tube while the escape is not in use, a bolt that passes through the extension tube and so fixes it inside the extension tube, a sponge base to be found on each platform at the bottom of the section of tube on that platform, a cover attached to the base of the extension tube, an auxiliary ladder attached to the platform railings, an extension inside the tube that prevents anybody from entering by means of the opening on the lower platform.

7 Claims, 5 Drawing Sheets

TUBULAR EMERGENCY EXIT FOR BUILDINGS

BACKGROUND OF THE INVENTION

There is currently a wide variety of systems that allow people, at a given moment, to escape from a building in the event of a fire within the actual building or in the event of an emergency in the area surrounding the building.

These types of systems are almost obligatory in most countries around the world, however these existing systems have serious drawbacks that many times cause tragedies instead of preventing them.

In Mexico, the number of buildings that completely lack adequate means of fast, easy, safe escape for occupants to a location where they will be safe in the case of an emergency, is alarming.

There are many reasons why currently, the vast majority of buildings do not have this means of escape. The main reason is the cost of installing such a system, but it also has a lot to do with the appearance of the building which could be affected by the fitting of multiple stairways, generally metallic, that could detract from the beauty of the building.

The goal of this invention is to provide an economical system that could be adapted to all architectural styles in such a way that this VITAL addition to any construction of three or more floors would firstly help provide a means for people to escape but secondly could be fitted so as to enhance the beauty of the building.

As the invention is explained in the description, many variations can be imagined and implemented, because of this it is not my intention to limit the scope of my invention to that described or illustrated in the corresponding drawings, but to completely reserve the rights to all modalities based on this application that produce the same industrial results.

BRIEF DESCRIPTION OF THE DRAWINGS

The characteristic details of this invention are clearly shown in the following description and the accompanying illustrative drawings which contain numbers referenced in the text describing parts of said drawings.

DETAILED DESCRIPTION OF THE INVENTION

Figure 1:
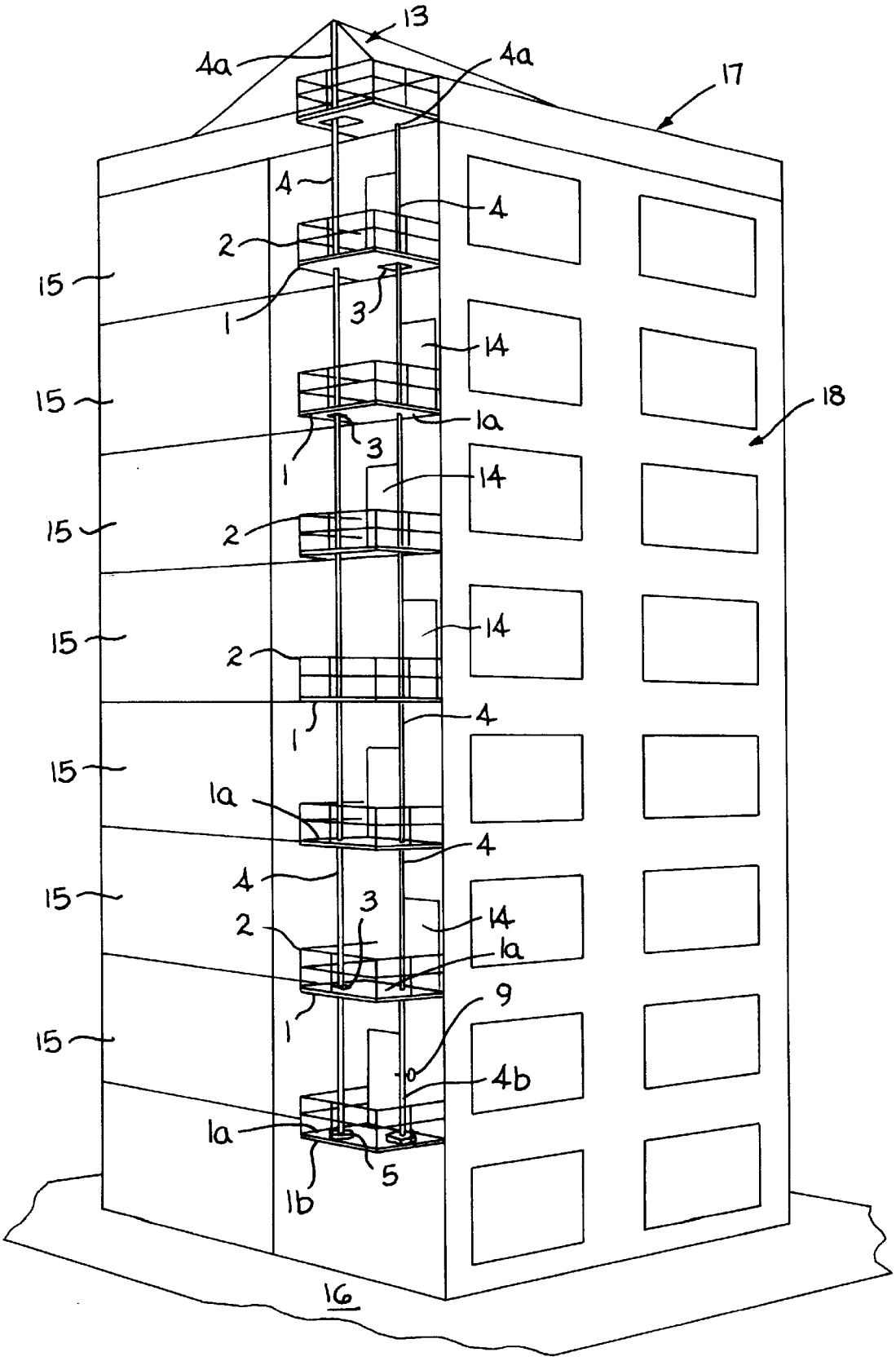
FIG. 1 shows an isometric perspective of a building that has the tubular escape system fitted.
Figure 2:
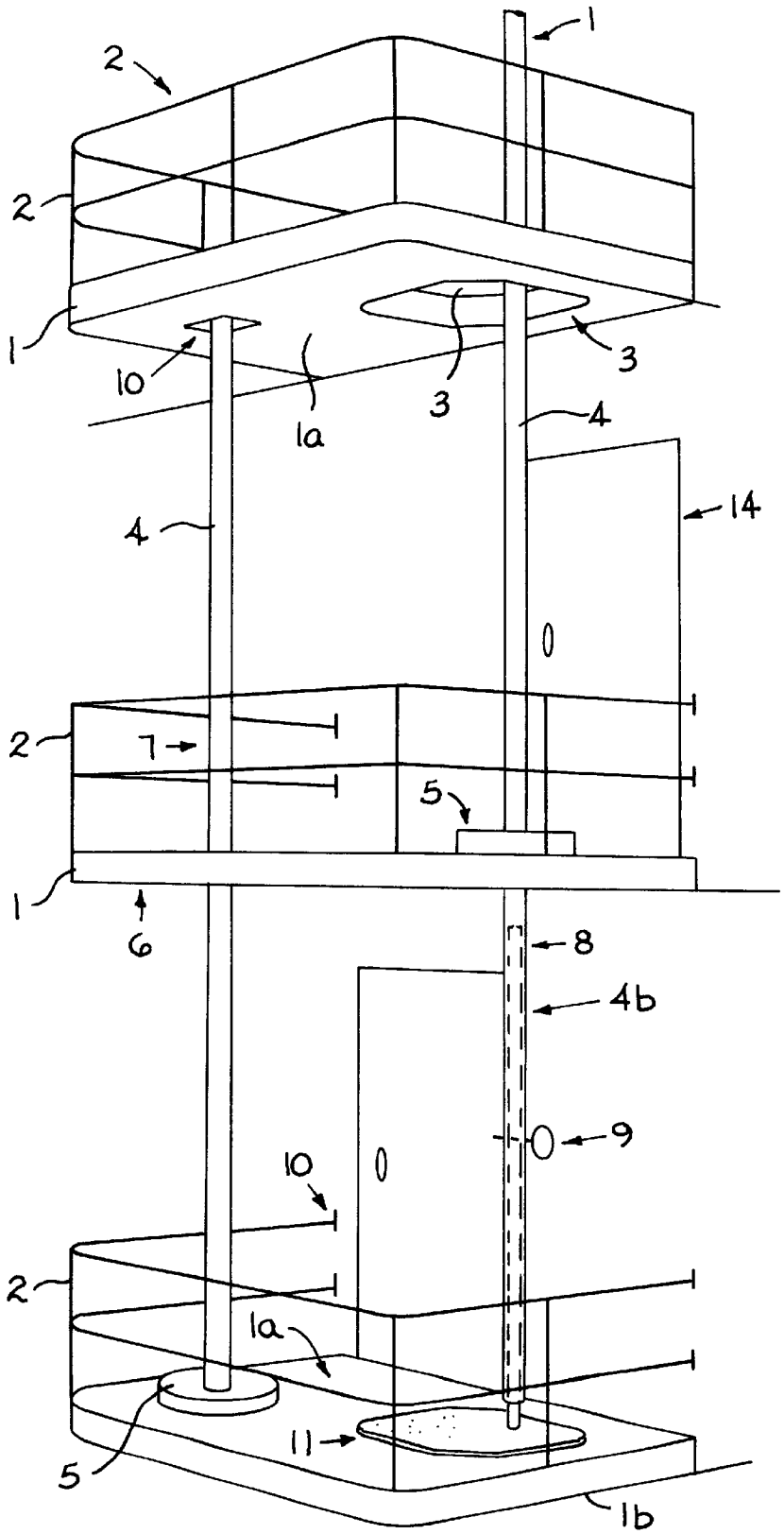
FIG. 2 shows an isometric view of a section of the building in which the 3 lower platforms of the system are illustrated.
Figure 3:
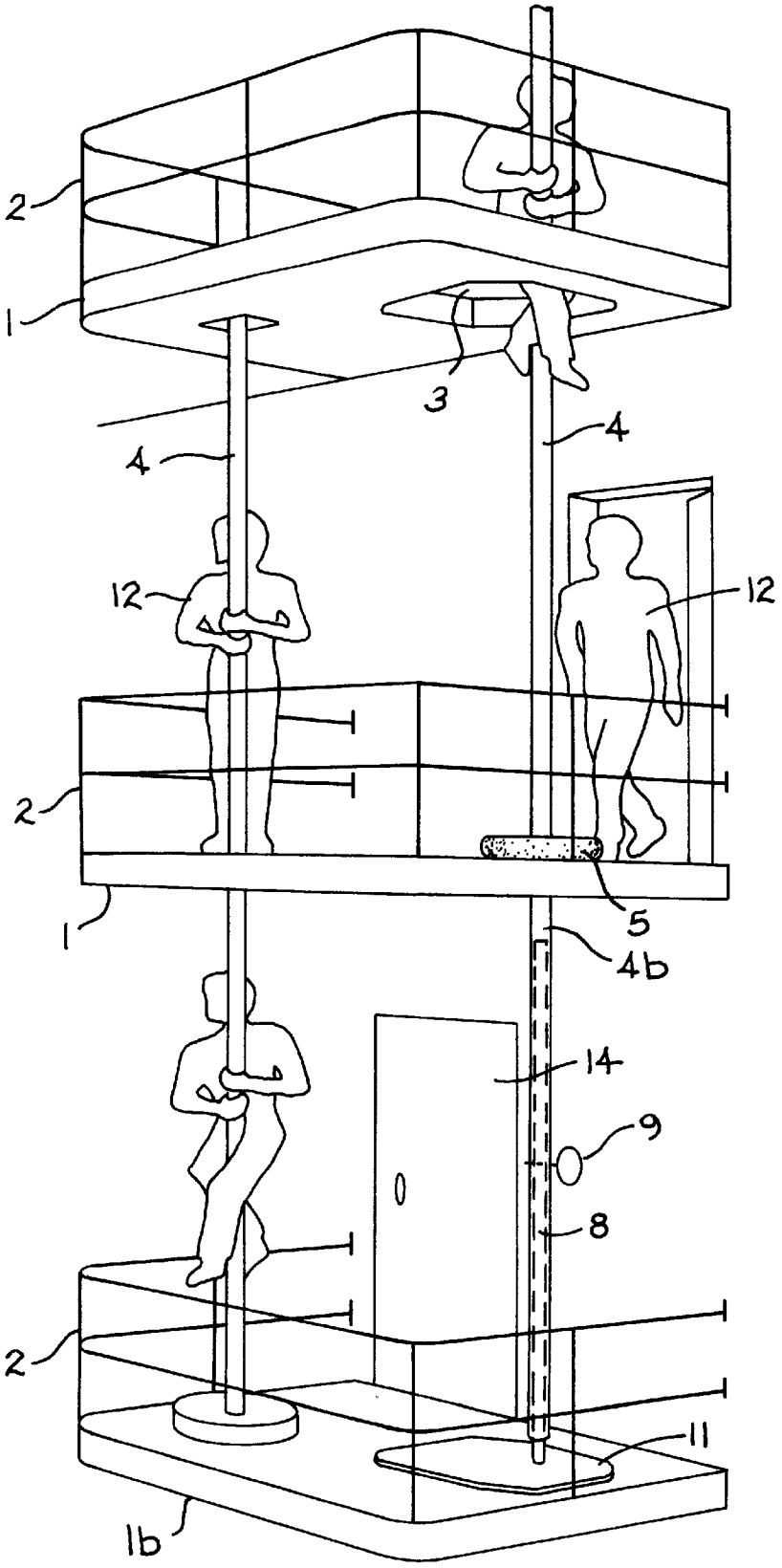
FIG. 3 shows an isometric view of a section of the building in which the 3 lower platforms of the system are illustrated with people using the system.
Figure 4:
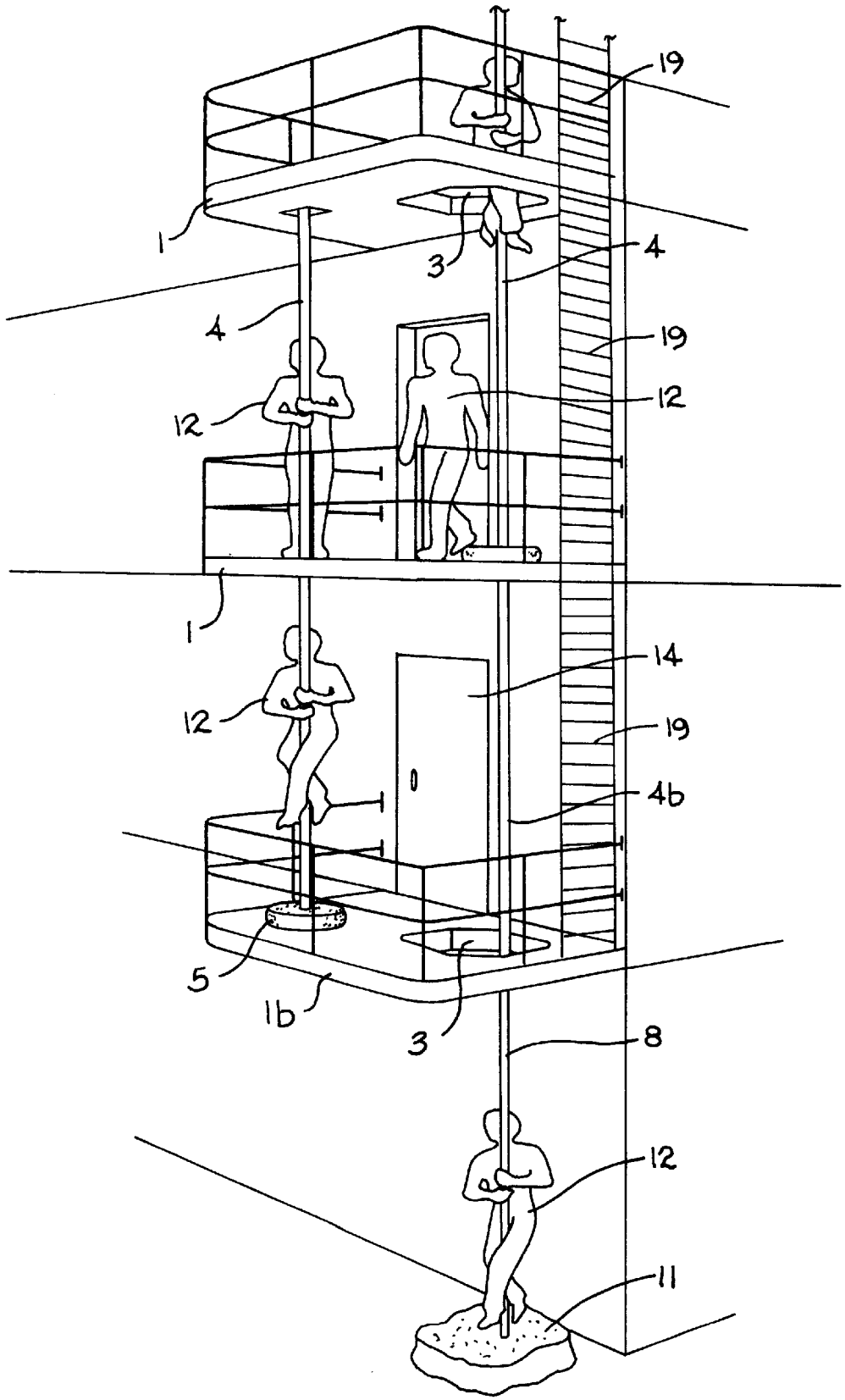
FIG. 4 shows an isometric view of a section of the building in which the 3 lower platforms of the system are illustrated with people using the system and one person on the ground.
Figure 5:
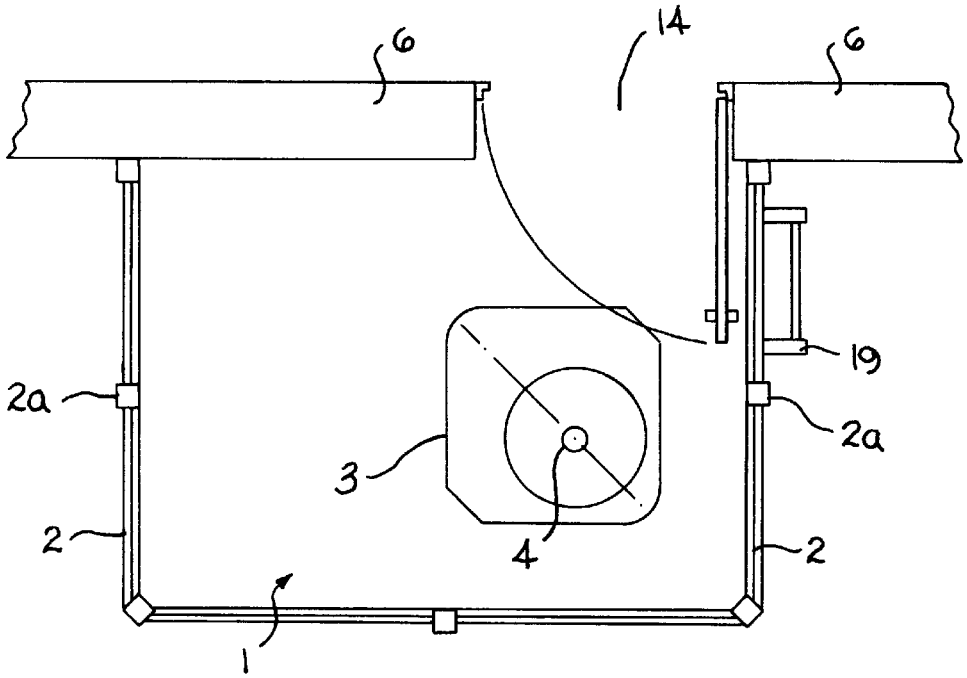
FIG. 5 shows a top view of the platform in which the descent opening is to be found on the right hand side.
Figure 6:
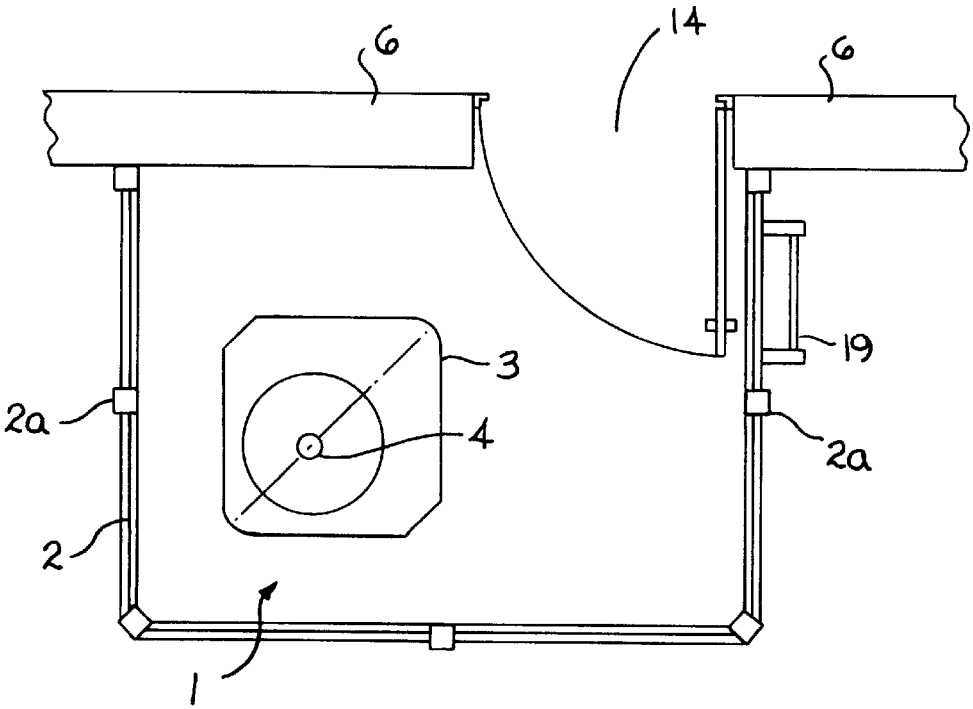
FIG. 6 shows a top view of the platform in which the descent opening is to be found on the left hand side.

Referring to said figures, this invention consists of a combination of a platform (1) which can be made from reinforced concrete or any other appropriate material, said platform (1) is ringed by multiple uprights **(2*a*) to which the platform (1) railings (2) are attached. With the goal of making the invention operationally practical there should be a door (14) from the interior to the platform (1) on each floor of the building (18). Each door (14) should be located so as to open to the side (1*a*) of the platform opposite the opening, so as that once the person (12) is on the platform (1)** he can slide down the tube to the floor below.

On each platform (1) there is a opening (3) with an ideal diameter of 1.00 meter, the person (12) using the escape can then pass through the opening (3). Said openings (3) are alternately located meaning that on one platform (1) the opening (3) would be on the right hand side and on the next it would be on the left hand side: the reason for alternating is to allow the person (12) to descend down the tube (4) only one floor (15) of the building (18) at a time. Once on the platform (1) the person would then move to the opening found on that platform (1) and descend to the platform (1) below.

This escape should come with a platform located on the roof (17) so that the people (12) who have gone up to said roof (17) to seek refuge also have the chance to use the ladder (19) and so ease the descent of an excess of people (12) that may at any given moment be present.

Each of the platforms (1) is perpendicularly crossed by two tubes (4) which are connected at the top **(4*a*) to a water tank (13) that manually or automatically can fill the tubes (4)** with water and so keep them cool and so allow the safe descent of those using the escape in the event of fire.

The tubes (4) should be placed eccentrically through the openings (3); that is to say, toward one side to allow a person's body more space to descend freely.

Each of the platforms (1) should be attached to the building (18) wall (6) by any appropriate means in such a way that permits safe use by the users.

Inside the innermost part **(4*b*) of the tube (4) that passes through the opening (3) of the final platform (1*b*) a telescopically inserted extension tube (8) is to be found, that remains inserted and fixed within the tube (4) by means of a bolt while the escape is not in use. When the escape is used the first person to arrive on that final platform (1*b*) simply removes the bolt (9) and the extension tube (8) automatically descends to allow the person to slide down said extension tube (8) to the ground (16)**.

Both tubes (4) are longitudinally secured on each platform (1) and at the base of the tube (4) where it meets the corresponding platform (1) there is a sponge base (5); the lower end of the extension tube (8) is fitted to a cover (11) which while the extension tube (8) is inside the tube (4) will prevent anyone from entering by means of the opening **(1*b*)** located nearest the ground.

What I claim is:

1. A tubular escape system in combination with a building having platforms, multiple uprights located around the perimeter of the platforms and supporting railings thereto the railings, a door connecting the building's interior on each floor with each platform, an opening in each platform measuring 1.00 meter in diameter, two tubes that perpendicularly cross each platform and are connected to a water tank on the roof of the building, the tank can manually or automatically fill the tubes with water, an extension tube that remains fixed and inserted within one of the tubes when the system is not in use, a bolt that passes through the extension tube and so fixes it inside said one of the tube, a sponge base on each platform at a lower end of a section of tube of said two tubes located between adjacent platforms, a cover attached to the base of the extension tube, an auxiliary ladder attached to the platform railings, the cover closes said opening in a lower platform to prevent entry to the lower platform.

2. A tubular escape system of claim 1, also characterized by every door being located so as to open on to an opposite side to that where the opening is located, so that, once on the platform, a person may grip the tube and slide down to the floor below.

3. A tubular escape system of claim 2, also characterized by the openings are located alternately, meaning that on one platform the opening would be on the right hand side and on the following platform the opening would be on the left hand side, to allow a person to descend down the tube only the height of a floor at a time.

4. A tubular escape system of claim 3, also characterized by of one said platform being located on the roof to allow people that have gone up to said roof to seek refuge also have the chance to use the ladder and so ease the descent of an excess of people that may at any given moment be present.

5. A tubular escape system of claim 4, also characterized by the tubes being be placed eccentrically through the openings that is to say, toward one side to allow a person's body more space to descend freely.

6. A tubular escape system of claim 5, also wherein upon removal of the bolt and the extension tube automatically descends to allow the person to slide down said extension tube to the ground.

7. A tubular escape system of claim 6, also characterized by both tubes being longitudinally secured to each platform.

* * * * *